United States Patent [19]

Menter

[11] Patent Number: 4,805,076

[45] Date of Patent: Feb. 14, 1989

[54] LIQUID CANDLE LAMP WITH DISPOSABLE FUEL CELL

[75] Inventor: J. Alan Menter, Manlius, N.Y.

[73] Assignee: Hollowick, Inc., Manlius, N.Y.

[21] Appl. No.: 179,665

[22] Filed: Apr. 11, 1988

[51] Int. Cl.[4] ..... F21L 19/00

[52] U.S. Cl. ..... 362/180; 431/320

[58] Field of Search ..... 431/320, 321; 362/163, 362/180

[56] References Cited

U.S. PATENT DOCUMENTS

| | | | |
|---|---|---|---|
| 729,463 | 5/1903 | Weidig | 362/180 |
| 866,018 | 9/1907 | Hamm | 362/180 |
| 3,994,672 | 11/1976 | Novak | 431/320 |
| 4,526,530 | 7/1985 | Menter et al. | 431/325 |

*Primary Examiner*—Carroll B. Dority, Jr.
*Attorney, Agent, or Firm*—Wall and Roehrig

[57] ABSTRACT

A liquid candle lamp having a base with an opening passing downwardly through the top surface of the base. A disposable fuel cell is positioned in the base opening. The cell has an expanded lower section that has a close running fit with the side wall of the opening and an upper section of smaller size that forms a vertical slot with the side wall of the opening. A burner is mounted upon the top of the fuel cell which is surrounded by a globe-like chimney that is seated upon the lamp base. A skirt depends from the globe and is received within the slot so that the fuel cell substantially fills all the usable space within the base opening thereby permitting a maximum quantity of fuel to be stored within the lamp base.

11 Claims, 2 Drawing Sheets

LIQUID CANDLE LAMP WITH DISPOSABLE FUEL CELL

BACKGROUND OF THE INVENTION

This invention relates to a liquid candle lamp and in particular, to a liquid candle lamp that includes a fuel cell for maximizing the quantity of fuel that can be stored within the lamp.

A liquid candle lamp is described in U.S. Pat. No. 4,261,695 which includes a hollow reservoir base capable of holding a quantity of a combustible fuel. A chimney is supported upon the reservoir and surrounds a burner which forms an integral part of the base. The base has a screw on cap that permits fuel stored in the base to be replenished. By making the entire base a fuel reservoir, a maximum amount of fuel can be stored in the lamp. The same combination of a base and fuel cell is found in many older oil burning lamps as illustrated in U.S. Pat. Nos. 1,042,656 and 888,139.

A new line of liquid candle table lamps have been devised which utilize a disposable liquid fuel cell. This type of disposable fuel cell is described in detail in U.S. Pat. No. 4,526,530 to Menter et al. The cell includes a straight walled cylindrical shaped container that is closed and sealed by a lid. A burner unit is mounted in the lid which wick is adapted to draw fuel from the container to a burning zone. In assembly, the fuel cell is inserted into a receiving opening formed in the base of the lamp and a chimney is seated upon the base over the cell. The chimney typically includes a dependent cylindrical skirt that is slipped downwardly into the opening around the container.

Although the disposable fuel cell described in the Menter et al. patent provides more than forty hours of continuous burning time, the users of lamps employing these types of cells are still looking for greater cell life. Although larger cells can be constructed, they will not be compatible with existing lamps and, more importantly, the bases required to accept the large cells have to be overly large and aesthetically unattractive.

SUMMARY OF THE INVENTION

It is therefore an object of the present invention to improve lamps that utilize disposable liquid fuel cells.

A further object of the present invention is to extend the burning time of disposable liquid fuel cells used in existing table lamps.

A still further object of the present invention is to provide a disposable fuel cell that will maximize the amount of fuel that can be stored in a liquid candle table lamp.

Another object of the present invention is to provide an inexpensive disposable liquid candle fuel cell that will deliver maximum burning time when used in association with a table lamp having a base and a chimney that is slidably received in said base.

These and other objects of the present invention are attained by means of a liquid candle lamp that includes in combination a base having an opening passing downwardly through the top surface and a transparent or translucent chimney that is seated upon the base. The chimney has a dependent skirt that complements the shape of the base opening and is slidably received therein. The chimney skirt provides a close sliding fit with the side wall of the opening and extends downwardly to a predetermined depth into the opening. A fuel cell which also complements the shape of the base is contained within the base. The cell has an upper section that substantially fills the interior of the chimney skirt and a lower section that substantially fills the base opening beneath the skirt whereby a maximum quantity of fuel is stored within the lamp base. The cell includes a burner equipped with a wick for bringing fuel from the cell to a burning region inside the chimney.

BRIEF DESCRIPTION OF THE DRAWINGS

For a better understanding of these and other objects of the present invention, reference is made to the following detailed description of the invention which is to be read in conjunction with the associated drawings, wherein.

DESCRIPTION OF THE INVENTION

Figure 2:
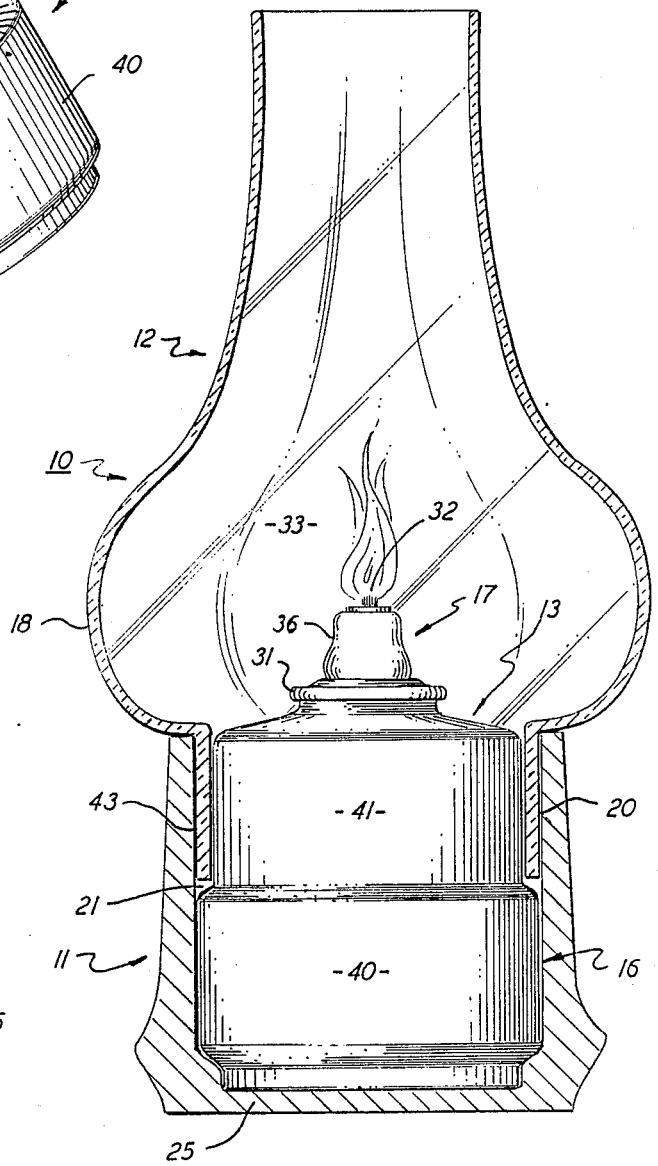
FIG. 2 is a side elevation in section showing a liquid candle lamp embodying the teachings of the present invention.

Turning now to FIG. 2, there is shown a liquid candle table lamp, generally referenced 10, of the type used in a restaurant or the like to provide intimate table lighting. The lamp includes a base 11, a chimney 12 and a fuel cell 13. As explained in detail in the previously noted Menter et al. patent, the fuel cell includes a container 16 which is equipped with a novel burner 17. The chimney 12 has a light transparent or translucent globe 18 seated upon the top surface of the base which surrounds the burner. A cylindrical skirt 20 depends from the chimney and is arranged to pass downwardly into a complementary opening 21 formed in the base to secure the chimney in assembly.

The base further includes a bottom wall 25 upon which the fuel cell rests in assembly. The height of the cell receiving opening 21 in the base is about equal to the axial depth of the container so that the burner unit 17 is situated above the base inside the chimney area.

Figure 1:
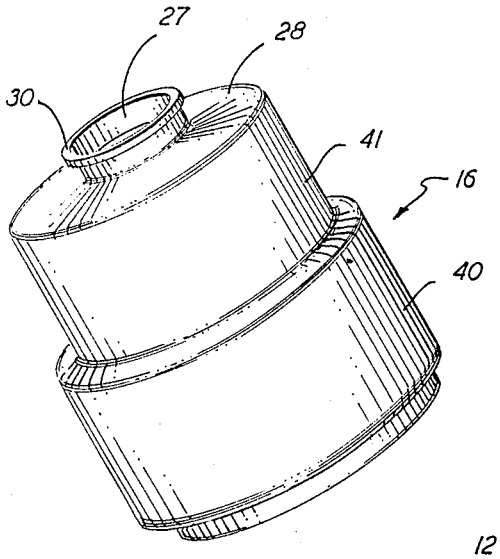
FIG. 1 is a perspective view of the disposable fuel cell that is contained within the lamp shown in FIG. 2.

An opening 27 is provided in the top wall 28 of the container which is surrounded by a raised circular flange 30 as illustrated in FIG. 1. The burner unit 17 is provided with a radially extended base 31 (FIG. 3) that is crimped over the circular flange in assembly and locked thereagainst to provide a leak tight seal. The burner is further equipped with a wick 32 which extends downwardly into the container to draw fuel via capillary action into the burning zone 33. As explained in greater detail in the noted Menter et al. patent, the burner contains a novel double venting system that allows for efficient and complete burning of the fuel. Preferably, the container is filled with a clean burning liquid paraffin.

Figure 3:
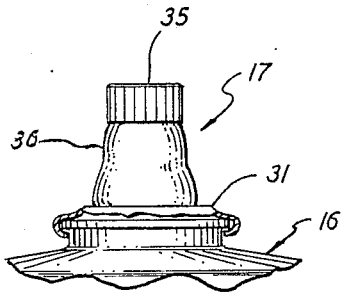
FIG. 3 is a partial side elevation with portions broken away showing the burner utilized in the lamp shown in FIG. 2.

As illustrated in FIG. 3, the burner further includes a snuffer skirt 36 that is seated upon the base 31. Although not shown, a cylindrical snuffer is suspended inside the skirt so that it encircles the wick beneath the burning zone when the skirt is in an upright position as shown.

In the event the lamp is tipped when the burner is lighted, the snuffer will automatically pass over the end of the wick to extinguish the flame and thus eliminate the risk of a fire. The burner is further equipped with a removable cap 35 that is fitted over the wick and seals against the burner to close off the fuel cell when it is not in use. The cap, like the burner, is more thoroughly explained in the previously noted Menter et al. patent and the disclosure of this patent is herein incorporated by reference to the extent necessary to understand the structure and function of the burner and cap assembly.

The fuel cell container 16 is shaped to complement the shape of the opening in the lamp base. The container shown in the present embodiment of the invention is cylindrical in form and contains an expanded lower section 40 and a narrower upper section 41. The outside diameter of the lower section 40 of the container is made slightly less than the inside diameter of the lamp base opening 21 to provide a close running fit between the container and the base. The narrower upper section 41 of the container is formed to a diameter that is slightly less than the inside diameter of the chimney skirt. The height of the upper section of the container is slightly greater than the axial length of the chimney skirt so that a circular slot 43 is formed between the base and the upper part of the container into which the chimney skirt is snuggly fitted in assembly. Accordingly, when the chimney is seated upon the base as illustrated in FIG. 1, all the lamp components are snuggly fitted together to provide for a compact, space saving assembly.

As should now be evident, the present lamp assembly makes maximum usage of all available space for fuel storage without sacrificing the aesthetic value of the lamp. Through more effective utilization of this space, the burning time of the disposable cell is extended by hours over those presently in use. The cell is further configured so that all the lamp elements fit snugly in assembly thus providing for a compact, space efficient unit. The tightness of the lamp assembly makes the lamp ideally well suited for use in restaurants and the like where table lamps are continually being handled as the tables are being cleared and reset. Loose fitting chimneys oftentimes fall out of the base when the lamp is being moved and becomes easily broken.

Figure 4:
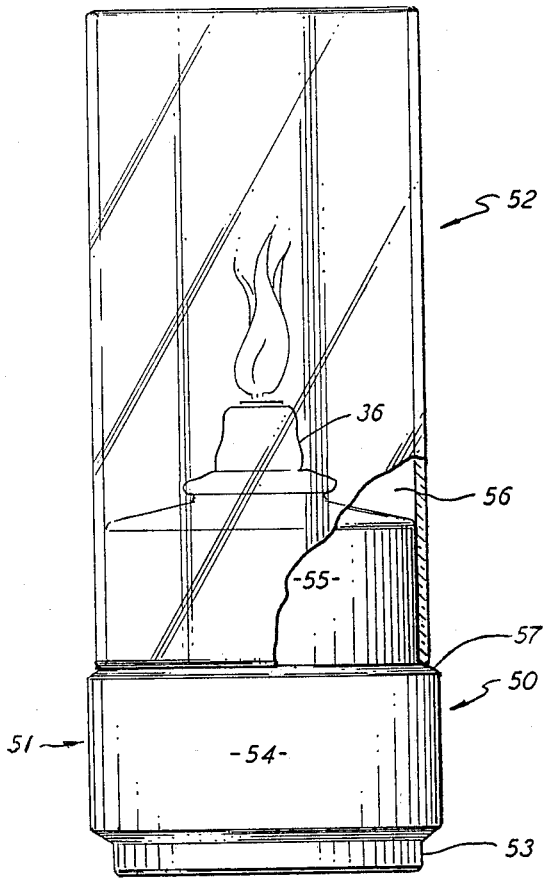
FIG. 4 is a second embodiment of the invention showing a chimney mounted upon a combination base and disposable fuel cell.

Turning now to FIG. 4, there is shown a second embodiment of the present invention. The lamp 50 includes a fuel cell 51 and transparent one piece chimney 52. The fuel cell 51 is again a cylindrical shaped unit that is preferably molded of plastic and contains a burner assembly 49 of the type described above. The fuel cell is intended to be a disposable unit which is to be replaced in assembly when the fuel supply stored therein has been depleted. The fuel cell has a base 53 having a flat bottom surface that can be securely seated upon a table top or a similar flat surface. The fuel cell further includes a wider lower section 54 and a less wide upper section 55.

A cylindrical translucent chimney 52 is mounted upon the fuel cell to complete the lamp assembly. The inside diameter of the chimney is substantially equal to that of the upper section of the fuel cell to provide a close running fit or a loose interference fit between the chimney and the base. In assembly, the chimney is slidably received upon the base and seats upon the radially extended shoulder 57 formed between the upper and lower sections of the fuel cell.

The height of the fuel cell from the bottom surface of the base to the top surface of the upper section is about equal to the outside diameter of the lower section 54. The height of the two sections are also about equal whereby the chimney can be well mounted upon the cell to a depth sufficient to insure that the chimney will be snugly supported upon the fuel cell. The height of the chimney should also be such that the lamp is not top heavy and thus not easily tipped while in use.

While this invention has been explained with reference to the structure disclosed herein, it is not confined to the details set forth and this application is intended to cover any modifications and changes as may come within the scope of the following claims.

What is claimed is:

1. A liquid candle lamp that includes in combination a base having an opening that passes downwardly through its top surface, a chimney that is seated upon the base and which has a hollow skirt depending therefrom that is slidably received in said opening, said skirt having a close running fit with the side wall of the opening and which extends partially into the opening to a predetermined depth, a fuel cell positioned in the base opening that has an expanded lower section that passes beneath the chimney skirt to substantially fill said opening beneath said chimney skirt and an upper section that is situated inside the skirt and which about fills the skirt opening whereby a maximum amount of fuel can be stored within said cell, and a burner mounted on top of said fuel cell having a wick for bringing fuel from inside the cell to a burning zone inside said chimney.

2. The lamp of claim 1 wherein the opening of the base has a floor upon which the fuel cell is seated.

3. The lamp of claim 1 wherein said cell is a disposable unit having a plastic body and a burner that includes a removable cap for enclosing said burner when it is not in use.

4. The lamp of claim 1 wherein the chimney is formed of a translucent material and the skirt penetrates the opening in the base to a depth that is about one-half the height of the base.

5. A liquid candle lamp that includes in combination a base having a cylindrical opening passing downwardly through the top surface of said base a cylindrical fuel cell positioned in said base opening, said cell having an expanded lower section of a first diameter that forms a close running fit with the side wall of said opening and an upper section of a second smaller diameter which forms a cylindrical, vertically disposed, slot with the wall of said opening a burner mounted in the top of said fuel cell containing a wick for bringing fuel stored in the cell to a burning zone, a chimney seated upon the base which surrounds the burning zone, said chimney having a cylindrical skirt depending therefrom that is slidably received within said slot for securing the chimney to said base.

6. The lamp of claim 5 whereby the fuel cell is formed of plastic and the burner is sealed in the cell to provide a sealed disposable unit that is replaceable within said base.

7. The lamp of claim 5 wherein the skirt of the chimney fills said slot.

8. The lamp of claim 5 wherein a horizontal shoulder is formed between the upper and lower sections of the fuel cell and said skirt of said chimney rests upon said shoulder.

9. The lamp of claim 8 wherein a close sliding fit is provided between the inside surface of said skirt and outside surface of said upper section of the fuel cell whereby the chimney is securely mounted in assembly.

10. The lamp of claim 5 wherein said base further includes a bottom wall in said opening upon which the fuel cell is seated.

11. The lamp of claim 5 wherein said burner further includes a removable cap which surrounds the wick and which seals against the burner to prevent fuel from escaping from said cell when the cell is not being used.

* * * * *